US005681105A

United States Patent [19]

Nau

[11] Patent Number: 5,681,105

[45] Date of Patent: *Oct. 28, 1997

[54] GROUND SUPPORTED LAMP

[76] Inventor: Larry J. Nau, 1733 Kinglett Rd., San Marcos, Calif. 92069

[ * ] Notice: The term of this patent shall not extend beyond the expiration date of Pat. No. 5,390,090.

[21] Appl. No.: 332,146

[22] Filed: Oct. 31, 1994

Related U.S. Application Data

[63] Continuation of Ser. No. 939,140, Sep. 2, 1992, Pat. No. 5,390,090, which is a continuation-in-part of Ser. No. 804,849, Dec. 9, 1991, abandoned.

[51] Int. Cl.[6] ..... E01F 9/04

[52] U.S. Cl. ..... 362/153; 362/153.1; 362/396

[58] Field of Search ..... 362/145, 152, 362/153, 153.1, 267, 365, 289, 396; 404/11, 12, 16; 52/28, 306, 308; 40/564, 565

[56] References Cited

U.S. PATENT DOCUMENTS 5,390,090 2/1995 Nau ..... 362/153

*Primary Examiner*—Y. My Quach

*Attorney, Agent, or Firm*—Robert J. Schaap

[57] ABSTRACT

A lamp in the shape of a brick and adapted for placement between bricks in a driveway or on roads, having an outer case, an electric bulb housing mounted in the case, a bulb socket supported on the bulb housing mounted in the case, and a translucent lens formed of a high strength plastic mounted on the top of the bulb housing. In a preferred embodiment the unit comprised of the bulb housing and lens is removable mounted in the case by means of lathing members. Resilient blocks receiving the lower ends of the screws to lock such unit to the case and is removable for replacing a bulb in the bulb socket or for cleaning the interior of the case. The screws in combination with the resilient blocks permit expansion and contraction of the bulb housing-lens unit while in locked position. For installation between bricks, e.g. in a driveway, the lamp is inserted between adjacent bricks and held in place by mortar.

20 Claims, 4 Drawing Sheets

FIG. 2
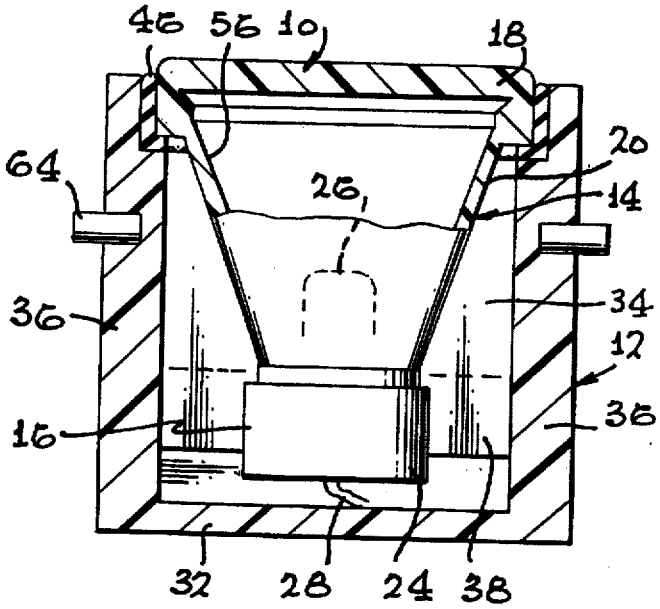
FIG. 5
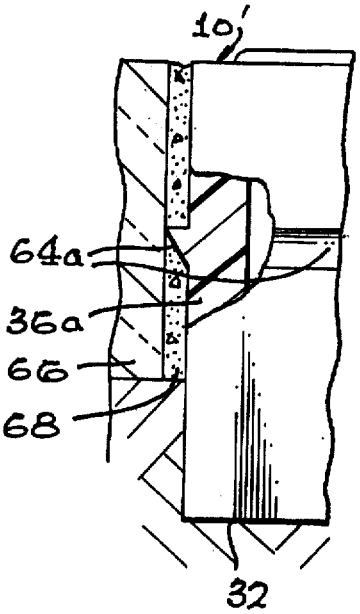
FIG. 4
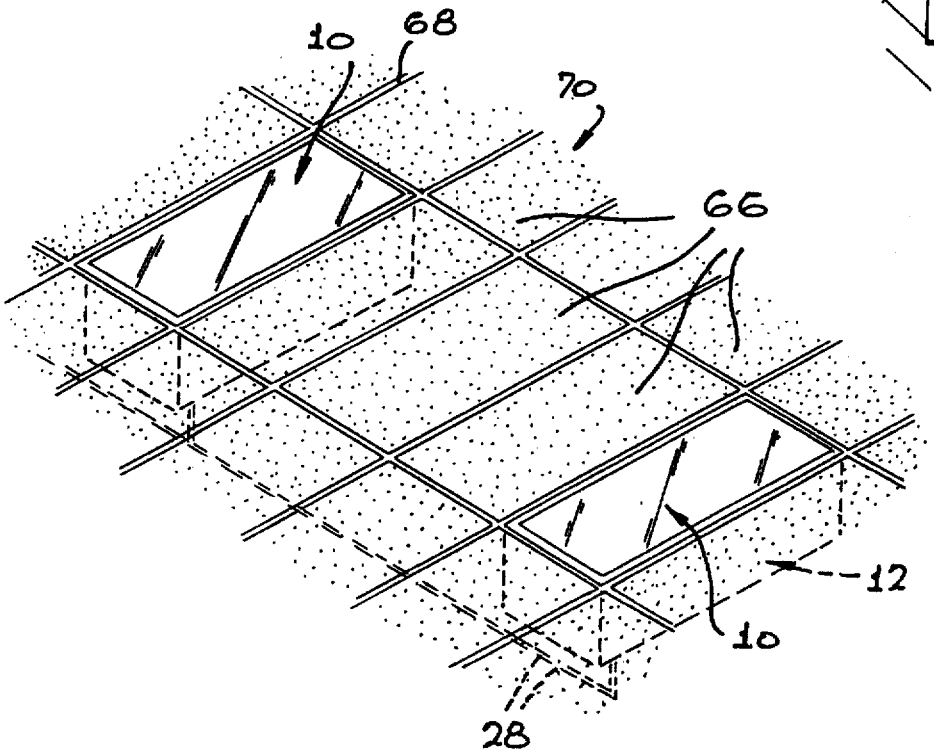
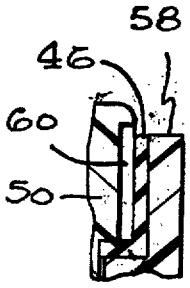
FIG. 3a

FIG. 11
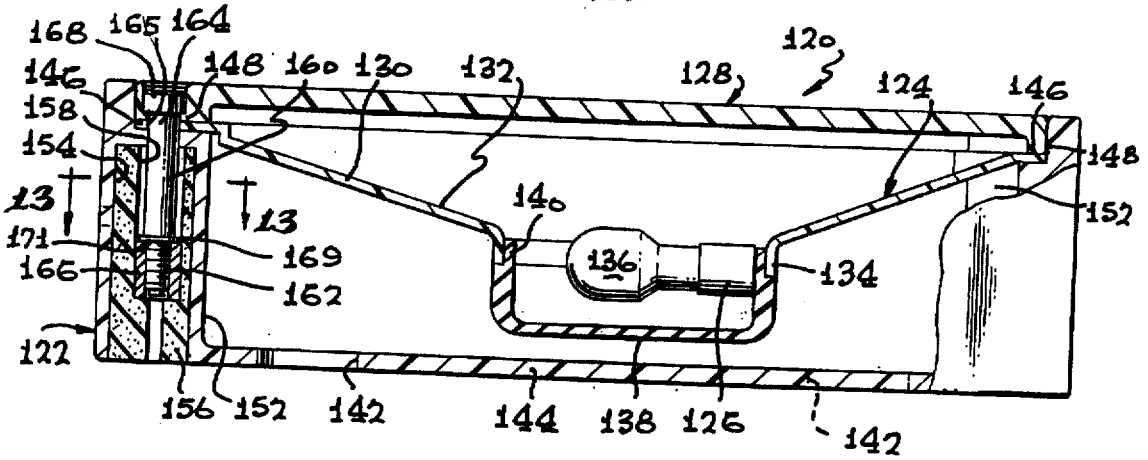
FIG. 12
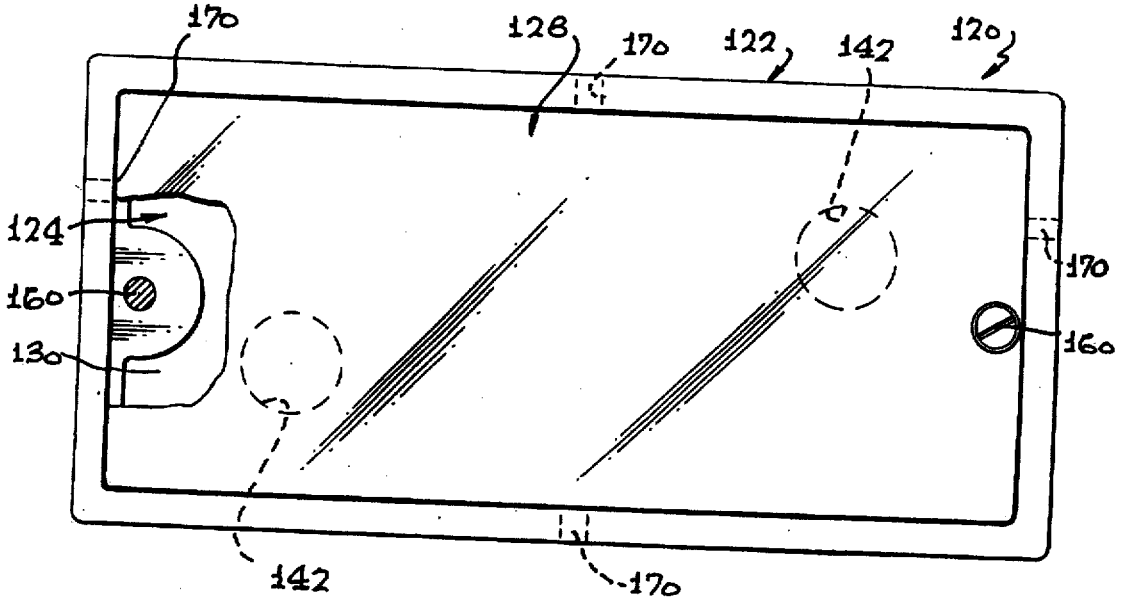
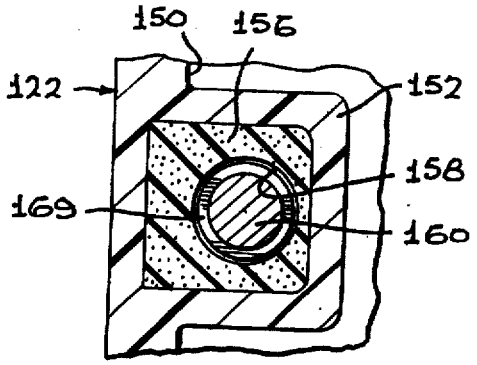
FIG. 13

GROUND SUPPORTED LAMP

This application is a continuation of my U.S. patent application Ser. No. 939,140, filed Sep. 2, 1992 for Ground Supported Lamp", now U.S. Pat. No. 5,390,090 dated Feb. 14, 1995, which application is a continuation-in-part of U.S. application Ser. No. 804,849, filed Dec. 9, 1991 now abandoned.

BACKGROUND OF THE INVENTION

This invention relates to a unique lamp particularly adapted to be supported at ground level, and is especially concerned with a lamp in the shape of a brick for insertion between bricks on a vehicle support surface such as a driveway or road surface, and hereinafter termed a "bricklight".

Current lighting fixtures for driveways and along roads are generally mounted above ground. However, such lighting fixtures, both in driveways and along roads are prone to being damaged or destroyed by vehicle collision. Further, leaning or damaged above-ground lighting fixtures present safety hazards. In addition, such lighting fixtures are subject to rusting, corroding or oxidizing, requiring replacement.

It is accordingly an object of the present invention to provide a unique lamp or lighting fixture which is adapted for placement on a flat support surface.

Another object is the provision of a lamp in the shape of a brick and which is adapted for placement between bricks in a driveway or on roads.

Yet another object is to provide a lamp or bricklight of the type noted above, which can be readily installed and portions thereof readily removed for replacement of bulbs and for cleaning the interior of the lighting fixture, and reinstalled.

A further object is to provide a lamp or bricklight as noted above which is designed to permit expansion and contraction of the interior structure of the bricklight under varying environmental conditions, e.g. freezing and thawing.

A still further object is the provision of a lamp or bricklight of the above type which will withstand vehicular traffic over an extended period of time.

A still further object is to provide a lamp of the above type constructed of materials which avoid rusting and corrosion.

SUMMARY OF THE INVENTION

The above objects are achieved according to the invention by the provision of a lamp, preferably in the shape of a brick, which is adapted for placement on a flat support surface, such as a driveway or a road, and particularly designed for placement between bricks in a road or driveway.

The bricklight of the invention generally comprises an outer case, preferably in the shape of a brick, means forming an electric bulb housing in the case, a bulb socket supported on the bulb housing, and a translucent lens supported on the bulb housing adjacent the top of the case and closing the interior of the case. There is also provided means for removably mounting the bulb housing in the case. The latter means includes a latching member for maintaining the bulb housing in normal latched position within the case, with means also provided to permit unlatching and removal of the bulb housing and associated lens for bulb replacement and cleaning of the interior of the case. Another feature is the provision of means in combination with the mounting means and permitting expansion and contraction of the bulb housing and the translucent lens supported thereon in the case.

In preferred practice, the electric bulb housing includes a downwardly inclined support member having an upwardly reflecting surface. The bulb socket is centrally and removably mounted on the lower end of such support member.

The outer wall of the case can have means, such as holes for the insertion of pins for locking the case in fixed position between adjacent bricks of a road or driveway.

Installation of the bricklight of the invention, e.g. in a brick driveway, is as simple as setting a brick, and is architecturally pleasing.

BRIEF DESCRIPTION OF THE DRAWINGS

FIG. 2 is a transverse cross section of the device shown in FIG. 1;

FIG. 3*a* illustrates a detail of the structure of the device of FIG. 1;

FIG. 4 is a perspective plan view which illustrates the bricklight of FIGS. 1 to 3, cemented in position between bricks in a driveway;

FIG. 5 illustrates a modification of the device of FIG. 1;

FIG. 11 is a cross-section of a preferred embodiment of the invention device;

FIG. 12 is a plan view of the lamp of FIG. 11, showing the lens partly broken away; and FIG. 13 is a cross section taken on line 13—13 of FIG. 11.

DETAILED DESCRIPTION OF PREFERRED EMBODIMENTS OF THE INVENTION

Figure 1:
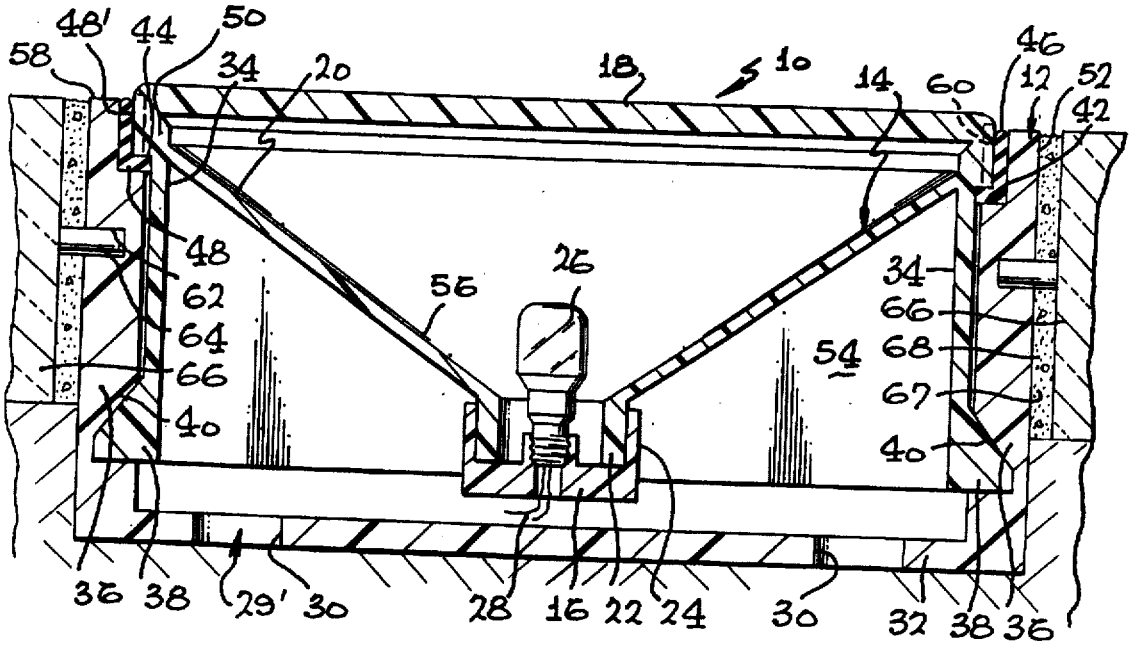
FIG. 1 is a longitudinal cross section of one embodiment of the lamp or bricklight of the invention, cemented between adjacent bricks.
Figure 3:
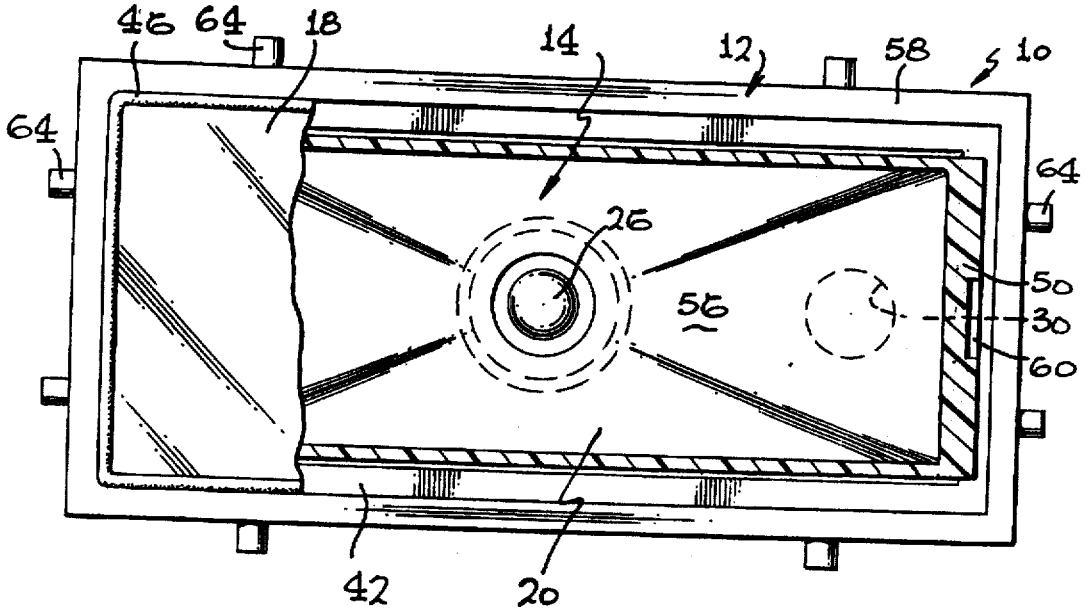
FIG. 3 is a plan view of the lamp of FIG. 1, showing the lens partly broken away.

Referring to FIGS. 1 to 3 of the drawing, numeral is a lamp or bricklight according to the invention, generally comprised of an outer rectangular case 12, an electric bulb housing 14 mounted within the case and an electric bulb socket 16 supported on the bulb housing 14. A translucent lens 18 is supported on the bulb housing adjacent the top of the case, and enclosing the interior of the case. The lens 18 is relatively thick and is constructed of a tough high strength resin, preferably a polycarbonate plastic, similar to materials used in manufacturing road reflectors, and will withstand the weight of vehicular traffic.

The case 12 and the electric bulb housing 14 are also preferably constructed of a high strength plastic such as ABS plastics.

The electric bulb housing 14 has a depending support member 20 which is downwardly inclined from the upper end of the bulb housing, with the bulb socket 16 being centrally positioned on the lower end of the support member. The support member 20 has a depending circular lip 22 at its lower end or extremity, and the bulb socket 16, e.g. formed Of rubber Or plastic has an upwardly extending cylindrical side 24, e.g. formed of soft rubber, in the form of a cap which can be stretched over and frictionally engages the lip 22 of the support member 20 and seals and holds the electric bulb socket 16 and an electric light bulb 26 mounted thereon in place during normal use. The flexible cap 24 permits easy removal from lip 22 and the bulb housing 14 for bulb replacement.

Wires 28 are connected to the socket 16, such wires being adapted to be connected in turn to wires (not shown) passing through one or more holes 30 in the bottom 32 of case 12 and connected to an external power source such as a low voltage system.

The bulb housing 14 has mounted thereon at its upper end, vertical side supports 34 which extend downwardly along the inside surface of wall 36 of case 12, and which terminate in a triangular tab 38 received in a similarly triangular shaped groove 40 in the side wall 36 of the case. In the normal operating position of the bricklight of the invention, as illustrated in FIG. 1, the tabs 38 on side supports 34 latch or cam the bulb housing 14 and the translucent lens 18 thereon in locked position within the case 12.

The inside wall 36 of the case is provided at its upper end with a shoulder 42, and an outwardly extending lug 44 on the upper end of the bulb housing 14 rests on shoulder 42. A flexible, e.g. rubber, seal or gasket 46 is disposed in the space 48 between shoulder 42 and lug 44, and extending upwardly in the space 48' between the upper end 50 of the bulb housing 14 and the adjacent upper side wall 52 of the case 12. The seal or gasket 46 is preferably of a soft resilient plastic or rubber which stretches around the upper end or top 50 of the bulb housing 14 and serves to align the lens 18 on the case and to prevent passage of debris into the interior 54 of the case. The seal 46 also prevents any significant amount of water from entering the interior of case 54.

Since holes 30 are provided in the bottom of the case, it will be apparent that moisture can enter into the interior 54 of the case below the bulb housing 14 and such moisture may freeze at low temperatures. Under such conditions the latching tabs 38 received in the grooves 40 of the case side wall aid in resisting upward pressure of the bulb housing 14 and the supported lens 18. Also, under thawing conditions, such latching tabs 38 tend to draw the bulb housing 14 and associated lens 18 back down into position as shown in FIG. 1.

The bulb housing 14 formed of the downwardly inclined support member 20 and the side supports 34 and associated tabs or latching members 38, can be molded in one piece from a suitable plastic and the plastic lens 18 can then be attached to the upper end or top of the bulb housing 14 by suitable means as by fusing these components together by heating and cooling to form an integral assembly, as shown, or if desired by the use of a suitable adhesive. The inside wall 56 of the downwardly inclined support members 20 of the bulb housing 14 facing lens 18 are reflecting surfaces as an aid to diffusing the light from electric bulb 26 passing through lens 18.

It will be noted that the outer side wall at the extreme upper end 50 of bulb housing 14, and the lens 18 supported thereon extend slightly above the top 58 of case 12. Slots 60 are provided in the outer wall at the upper end 50 of bulb support 14, such slots extending in such wall upwardly to just above the top 58 of the case 12. See also FIG. 3*a*. A pair of such slots are provided at opposite ends of the bulb housing 14. When it is desired to remove the bulb housing 14 and its associated components including side supports 34 and lens 18 from the interior of the case, e.g. for replacement of an electric bulb and/or cleaning of the interior of the case, this can be achieved by insertion of a suitable instrument such as a screwdriver into one or both of the slots 60, and urging the bulb housing 14 and its associated components upwardly so as to disengage the tabs 38 on side supports 34 from their locked or cammed position in grooves 40 and permit removal of the bulb housing and the lens from the case. During such upward movement, the seal 46 is also removed.

The entire unit of bulb housing 14, with side supports 34, and lens 18 can be readily replaced simply by inserting the unit with the seal 46 around the bulb housing, into the interior of the case and reinserting the tabs 38 into latching position in grooves 40. It will be noted that side supports 34 have sufficient resilience to be flexed during movement of tabs 38 out of grooves 40 and removal of bulb housing 14, and during replacement thereof in the case and snapping of tabs 38 back into grooves 40. It is also noted that in such operative position of the lamp, the seal 46 also functions to cushion the Weight of vehicles passing over the bricklight.

The invention device is also preferably provided with holes 62, for example two such holes in each side of the case, for insertion of steel pins 64 to aid in installation of the lamp as between bricks. Thus, just prior to placement and setting of the device 10 between bricks 66, steel pins 64 are inserted into holes 62, the pins extending Outwardly a short distance beyond the outer surface of the walls of case 12. The unit 10 with the pins 64 therein can then be placed between bricks, with the protruding ends of the pins 64 extending into the space 67 between the bricklight 10 and the adjacent bricks 66. Mortar or cement, indicated at 68 is then placed in the space 67, embedding the pins 64 in the mortar, and thus rigidly securing the case 12 of the lamp unit in position in the ground adjacent the associated bricks. It will be noted that the height of the bricklight 10 of this embodiment of the invention is normally somewhat greater than the height of a brick, in order to provide sufficient clearance in the invention lamp, between the bulb 26 and the lens 18.

FIG. 4 illustrates placement of a plurality of lamps or bricklights 10 between bricks 66 of a driveway 70, as above described.

Various modifications of the invention device can be made. Thus, as seen in FIG. 5, the unit or lamp 10' can contain in side wall 36*a* outwardly extending protuberances or lugs 64*a* to lock the lamp in position in the mortar 68 between adjacent bricks 66, instead of employing the holes 62 and pins 64 of the device of FIGS. 1 to 3.

FIGS. 6 to 10 illustrate a modification of the device of FIGS. 1 to 3, and which is designed to have the same height as a standard brick. The device 72 has a case 74, an electric bulb housing 76 mounted within the case and an electric bulb socket 78 supported on bulb housing 76. A lens 80 similar to lens 18 is supported on the bulb housing 76.

The electric bulb housing 76 has a depending downwardly inclined support member 82, which has a reflecting upper surface 83 facing lens 80, and has a depending lip 84. On one side of the lip and disposed at an acute angle is positioned bulb socket 78 in which is mounted an electric light bulb 86. In this embodiment it is noted that the bulb 86 is disposed in socket 78 at a relatively small acute angle to the horizontal plane. A soft rubber cap 88 is stretched over and frictionally engages the lip 84 for easy removal therefrom for bulb replacement.

Figures 6, 7, 8, 9, 10:
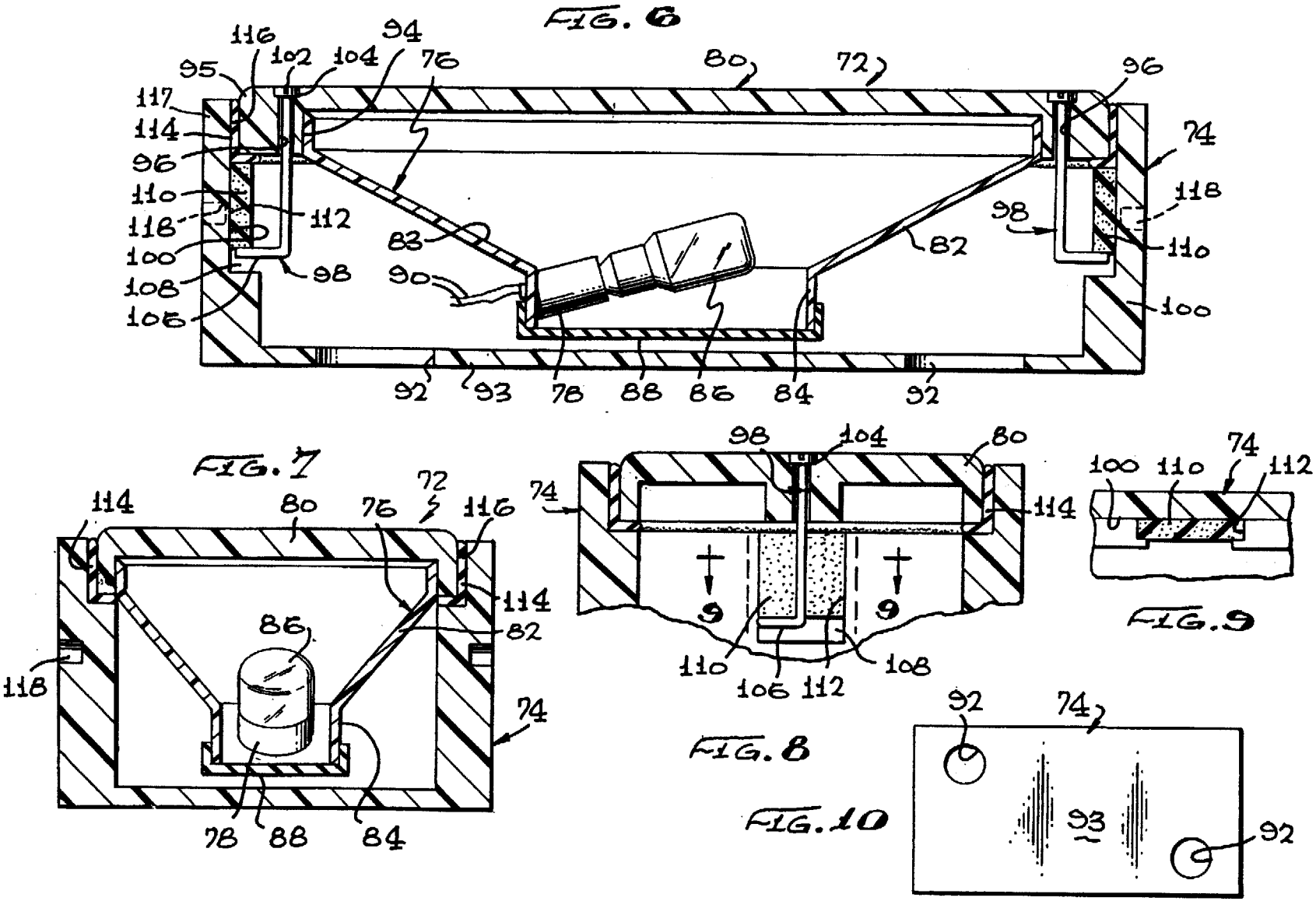
FIG. 6 is a longitudinal cross section of another embodiment of the invention device.
FIG. 7 is a transverse cross section of the device shown in FIG. 6.
FIG. 8 is an interior cross-sectional end view of the top portion of the device of FIG. 6.
FIG. 9 is a cross-sectional detail taken on line 9—9 of FIG. 8.
FIG. 10 is a bottom view showing the position of the holes therein for external passage of the electric wires.

Wires 90 connected to socket 78 extend over the upper edge of cap 88 and are disposed in the case in the space below the support member 82. Holes 92 in the bottom 93 of the case 74 are diagonally disposed, as seen in FIG. 10, to facilitate passage of wires (not shown) from an external power source, for attachment to wires 90.

In view of the positioning of the bulb socket 78 and the bulb mounted therein at an acute angle, this permits reduction in the height of the bricklight of this embodiment as compared to that of FIG. 1, so that the height of the device of the present-embodiment is the same as that of an adjacent conventional paving brick when such device is used in combination therewith as described above.

The bulb housing 76 formed of the downwardly inclined support member 82 molded of a suitable plastic can be welded as by sonic welding at 94 to the outer depending edge portions 95 of lens 80.

Mounted in vertical holes 96 in the edge portion 95 adjacent opposite ends of the lens 80 are a pair of hook pins 98, e.g. of stainless steel, which are fully rotatable in such holes and extend downwardly into the case adjacent the end walls 100 thereof. The hook pins 98 each has a slot 102 in the head 104 thereof to permit insertion of a suitable tool into the slot for rotation of the pin. The lower end of each pin 98 has a hook 106 which is receivable within a slot 108 of the case end walls 100, and into contact with the lower end of a pad 110, e.g. of siliconized rubber, to thereby lock the assembly of bulb housing 76 and lens 80 in position on the case. The rubber pads 110 are fixedly mounted in a vertical slot 112 of the case end walls 100. When it is desired to remove the unit including bulb housing 76 and its associated components 78 and 86 from the interior of the case for replacement of the bulb and/or cleaning of the case interior, hook pins 98 are rotated to remove the hook 106 from slots 108, as seen in FIG. 8, to thereby permit such unit to be raised and removed from the case interior.

The purpose of the rubber pad 110 in conjunction with the hook pin 98 as a locking mechanism is that if the interior of the case should fill up with water and freeze, causing the bulb housing 76 and its associated components to expand upwardly, the hook 106 of the hook pins 98 at opposite ends of the device would push up into the lower end of the adjacent rubber pads 110, and lift the bulb housing 76 and lens 80 an amount sufficient to avoid damage to these structures, and when the interior of the case thaws out by a rise in temperature, the resilient pads 110 push the hooks 106 down to contract or return the bulb housing 76 and lens 80 back into normal locked position within the case as seen in FIG. 6.

A flexible seal 114 is disposed in the space 116 between the outer edge 95 of lens 80 and the adjacent upper end 117 of end walls 100 of the case, similar to seal 46 in FIG. 1. As previously indicated, although some water may leak through such seal into the interior of the case, the seal functions chiefly to prevent dirt and debris from entering the case, for maintaining the lens in alignment by keeping the space 116 around the lens even and as a cushion between the unit comprised of members 76 and 80 and their associated components, and the adjacent walls of the case. Holes 118 are provided in each side of the case for insertion of steel pins, similar to holes 62 in FIG. 1, to aid in installation and locking of the lamp case between bricks, as described above.

FIGS. 11 to 13 illustrate another modification which is a preferred form of the invention device. The device or lamp 120 has an outer case 122, an electric bulb housing 124 mounted within the case and an electric bulb socket 126 supported on bulb housing 124. A lens 128 similar to lens 80 in FIG. 6 is supported on bulb housing 124.

The electric bulb housing 124 has a depending downwardly inclined support member 130, which has an upwardly reflecting surface 132 and a depending lip 134. On one side of the lip and disposed in a horizontal plane is positioned bulb socket 126 in which is mounted an electric light bulb 136 disposed in a horizontal plane. A soft rubber cap 138 is compressed at 140 around the inside surface of the lip 134 and frictionally engages the lip.

Wires (not shown) are connected to socket 126, as in FIG. 6, and are disposed in the case below the support member 130, such wires passing through the diagonally disposed holes 142 in the bottom 144 of case 122, for attachment to an external power source.

The bulb housing 124 formed of the downwardly inclined support member 130 molded of suitable plastic is welded as by sonic welding at its Outer edge portion 146 to the outer depending edge portions 148 of lens 128.

The interior opposite end walls 150 of the case 122 have inwardly extending portions 152, forming downwardly extending cavities 154 in such opposite end walls. Positioned in each of such cavities is an elastomeric or flexible rubber block 156, which extends essentially to the bottom 144 of the case. The blocks 156 each has vertical cavity 158. Mounted on edge portions 148 at opposite ends of the lens 128 are a pair of elongated screws 160 which extend downwardly into the cavities 158. The upper portions 164 of the screws 160 pass through holes 165 in the outer edge portions 148 and 146 of lens 128 and support member 130.

The lower threaded ends 162 of screws 160 are received in an internally threaded member such as nut 166 molded into the lower ends of each of the blocks 156, to lock the assembly of the bulb housing 124 and lens 128 in position on the case, as seen in FIG. 11. The bulb housing 124 and its associated socket and bulb 126 and 136, respectively, can be removed from the interior of the case for bulb replacement or cleaning, by rotating the head 168 of screws 164, to release the lower ends 162 of the screws from engagement with the nuts, and raising screws 160. A retainer ring 169 is mounted in a notch 171 just above the threaded end 162 of the screws, to function as stops which make contact with the edge portions 146 of support members 130 when the screws are pulled up, to retain the screws on the assembly of the bulb housing 124 and lens 128 and to permit lifting and removal of such assembly from the-case by means of the screws.

The screws 160 and nuts 166 in conjunction with the resilient blocks 156, as in the case of hook pins 98 and rubber pads 110 in the embodiment of FIG. 6, function as a locking mechanism, and also as a mechanism to permit expansion and contraction of the bulb housing 124 and the lens 128 thereon while locked in position in the case. Thus, if the interior of the case fills with water and freezes, causing the bulb housing and its associated components to expand upwardly, the resilience of blocks 156 would allow the screws 160 to lift the bulb housing 124 and lens 128 an amount sufficient to avoid damage to these structures, and when the interior of the case thaws out, the resilient blocks 156 retract, pulling the screws 160 down to return the bulb housing 124 and lens 128 back into normal locked position in the case, as in FIG. 11.

The outer edges of the lens 128 are disposed closely adjacent to the upper inner wall of the case. Holes 170 are provided in the sides of the case for insertion of pins for locking the lamp case between bricks, as noted above.

From the foregoing, it is seen that the invention provides a rugged lamp or lighting fixture which is particularly suitable for surface lighting and installation in ribbon bricking or driveways, as stair risers, in cement slabs, around swimming pools, within a brick pathway or roadway, or on any flat surface. The bricklight provides clear and bright illumination due to its reflective and lens diffusion design. It eliminates the use of above ground lighting fixtures in driveways, roadways or other areas which are subject to damage or destruction and eliminates the safety hazards of current above ground fixtures. Further, the invention device permits facile removal for bulb replacement or cleaning. The device will particularly withstand vehicular traffic over extended periods of time.

Since various modifications of the invention device will occur to those skilled in the art, within the spirit of the invention, the invention is not to be taken as limited except by the scope of the appended claims.

What is claimed is:

1. A lamp for placement on a support surface which comprises:

an outer case having a top, sides and an interior, said outer case having a brick shape, said lamp simulating a brick, means forming an electric bulb housing supported in said outer case, an electric bulb socket supported on said electric bulb housing, a translucent lens supported on said electric bulb housing adjacent the top of said case, and closing the interior of said outer case, means removably mounting said electric bulb housing and said translucent lens in said outer case, and means in combination with said removably mounting means and permitting expansion and contraction of said bulb housing and said translucent lens supported thereon in said outer case.

2. The lamp of claim 1, said means removably mounting said electric bulb housing and said translucent lens in said outer case and said means in combination with said removably mounting means and permitting expansion and contraction of said electric bulb housing and said translucent lens supported thereon comprising releasable locking members connected to said electric bulb housing and said translucent lens, and resilient members mounted in said outer case, said releasable locking members being engaged with said resilient members for releasably locking said electric bulb housing and said translucent lens in position in said outer case, and said resilient members and said releasable locking members permitting expansion and contraction of said bulb housing and said translucent lens thereon while in locked position in said outer case.

3. The lamp as defined in claim 2 in combination between bricks on a vehicle support surface.

4. The lamp of claim 1, said outer case having inside walls, said means removably mounting said electric bulb housing and said translucent lens thereon including rotatable hook pins having lower ends and mounted adjacent opposite ends of said translucent lens and said electric bulb housing, and extending downwardly adjacent the inside walls of said outer case, and including a hook at the lower end of each of said rotatable hook pins, said means in combination with said removably mounting means and permitting expansion and contraction of said bulb housing and said translucent lens supported thereon comprising resilient pads mounted on the inside walls of said outer case adjacent said hook pins, the hooks on said hook pins being engagable with said resilient pads for locking said electric bulb housing and said translucent lens in position in said outer case.

5. The lamp of claim 1, said outer case having inside walls, said means removably mounting said electric bulb housing and said translucent lens thereon including elongated screws having lower threaded ends and mounted adjacent opposite ends of said translucent lens and said electric bulb housing, and extending downwardly adjacent the inside walls of said outer case, said means in combination with said removably mounting means permitting expansion and contraction of said bulb housing and said translucent lens supported thereon comprising resilient blocks mounted adjacent the inside walls of said outer case, internally threaded members positioned in said resilient blocks for receiving the lower threaded ends of said screws for locking said electric bulb housing and said translucent lens in position in said outer case.

6. The lamp of claim 5, said resilient blocks each having a downwardly extending cavity with a lower end, said elongated screws received in said cavities, said internally threaded members being nuts embedded in said resilient blocks adjacent the lower ends of said cavities.

7. The lamp of claim 5, said electric bulb housing having upper ends and said translucent lens having outer ends, the upper ends of said electric bulb housing being integrally connected to the outer ends of said translucent lens, said screws each passing through holes in each of the outer ends of said translucent lens and each of the upper ends of said electric bulb housing, said screws each having a head at the upper end thereof for rotation of said screw to engage and disengage said screw from said internally threaded member, and retainer means on said screws for maintaining said screws connected to said electric bulb housing and said translucent lens when said screws are disengaged and pulled up from said internally threaded members.

8. The lamp of claim 5, said translucent lens having downwardly depending edge portions, said downwardly depending edge portions being integrally connected to said electric bulb housing, said outer case having upper end walls, the downwardly depending edge portions of said translucent lens being positioned around said upper end walls of said outer case.

9. The lamp as defined in claim 1 in combination with bricks on a vehicle support surface.

10. A lamp in the shape of a brick and adapted for placement between bricks in a driveway or on roads, which comprises:

an outer rectangular case of substantially brick shape and having an interior, side walls and end walls, an electric bulb housing mounted in said case and having a top, and including a downwardly inclined support member, said support member having a lower end and an upwardly reflecting surface, a translucent lens formed of a high strength plastic and disposed across and supported on the top of said bulb housing and closing the interior of said case, socket supporting means at the lower end of said support member, an electric bulb socket engaged by said socket supporting means, a cap engaging the socket supporting means of said support member, elongated fastener members having upper ends and lower ends, the upper ends being connected to opposite ends of said lens and said electric bulb housing, said elongated fastener members extending downwardly adjacent the side walls of said case, downwardly extending resilient blocks positioned adjacent opposite end walls of said case, means operatively associated with said fastener member at each of said resilient blocks adjacent the lower end thereof for receiving the lower end of said fastener member for locking said electric bulb housing and said translucent lens in said outer case, said resilient blocks permitting expansion and contraction of said bulb housing and said translucent lens supported thereon while in locked position in said case, and means associated with each of said fastener members for maintaining said fastener members connected to said electric bulb housing and said translucent lens when said fastener members are disengaged and pulled upwardly.

11. The lamp of claim 10, and including an electric light bulb in said electric bulb socket, electric wires connected to said electric bulb socket, said outer rectangular case having a bottom and means forming holes in the bottom of said outer rectangular case for passage of electric wires from said electric bulb socket externally of said case for connection to a power supply.

12. The lamp of claim 10, said translucent lens being formed of a polycarbonate resin.

13. The lamp of claim 10, including holes in the sides of said outer rectangular case for insertion of protruding pins to maintain said lamp in position between bricks by insertion of mortar around the pins and in the space between the lamp and adjacent bricks.

14. The lamp as defined in claim 2 in combination between bricks on a vehicle support surface.

15. A lamp for placement on a support surface which comprises:

an outer case having a top, sides and an interior, said outer case having a brick shape and capable of being located on said support surface, said lamp simulating a brick, means forming an electric bulb housing supported in said outer case, an electric bulb socket supported on said electric bulb housing, a translucent lens supported on said electric bulb housing adjacent the top of said outer case and closing the interior of said outer case, means removably mounting said electric bulb housing and said translucent lens in said outer case, said means forming an electric bulb housing including a depending downwardly inclined support member having a lower end, said depending support member having a depending lip at the lower end thereof, and said electric bulb socket being centrally removably mounted on the depending lip of the lower end of said depending support member, said support member having an upwardly reflecting surface, a flexible cap frictionally engaging the depending lip of said support member, said electric bulb socket mounted in said cap, and said outer case having a bottom, and including at least one aperture in the bottom of said outer case for passage of electrical wires from said bulb.

16. A lamp for placement on a support surface which comprises:

an outer case having a top, sides, an interior, said outer case having a brick shape and capable of being located on said support surface, said lamp simulating a brick, means forming a housing supported in said outer case, lighting means supported on said housing, a translucent lens supported on said housing adjacent the top of said case, and closing the interior of said outer case, means removably mounting said housing and said translucent lens in said outer case, and means permitting expansion and contraction of said housing and said translucent lens in said outer case.

17. The lamp of said claim 16, said lighting means comprising an electric bulb socket.

18. A lamp in the shape of a brick and adapted for placement between bricks in a driveway or on roads, which comprises:

an outer rectangular case of substantially brick shape and having an interior, inside walls and end walls, an electric bulb housing mounted in said case and having a top, and including a downwardly inclined support member, said support member having a lower open end, a translucent lens formed of a high strength plastic and disposed across and supported on the top of said bulb housing and closing the interior of said case, socket support means at the lower open end of said support member, an electric bulb socket carried by said socket supporting means at the lower open end causing light to be incident on said lens when a bulb in said socket is energized;

elongate fastener means securing said lens and said electric bulb housing to said case, said fastener means extending downwardly adjacent the inside wall of said case, and resilient blocks positioned adjacent opposite end walls of said case, said blocks each receiving a separate fastener means for locking said electric bulb housing and said translucent lens in said outer case, said resilient blocks permitting expansion and contraction of said bulb housing and said translucent lens supported thereon while in locked position in said case.

19. The lamp of claim 18 wherein said bulb socket is mounted on said socket supporting means and projects through said lower open end, and including an electric light bulb in said electric bulb socket, and electric wires connected to said electric bulb socket.

20. The lamp of claim 19, said outer rectangular case having a bottom and means forming holes in the bottom of said outer rectangular case for passage of electric wires from said electric bulb socket externally for connection to a power supply.

* * * * *